US010364080B2

(12) United States Patent
Tetreault et al.

(10) Patent No.: US 10,364,080 B2
(45) Date of Patent: Jul. 30, 2019

(54) CAN CARRIER

(71) Applicant: Roberts Polypro Inc., Charlotte, NC (US)

(72) Inventors: Roy A. Tetreault, York, SC (US); Jesse Lee G. Plume, Concord, NC (US); Richard T. Brothers, Clover, SC (US)

(73) Assignee: ROBERTS PLYPRO INC., Charlotte, NC (US)

( * ) Notice: Subject to any disclaimer, the term of this patent is extended or adjusted under 35 U.S.C. 154(b) by 0 days.

(21) Appl. No.: 15/707,168

(22) Filed: Sep. 18, 2017

(65) Prior Publication Data

US 2018/0086524 A1 Mar. 29, 2018

Related U.S. Application Data

(60) Provisional application No. 62/399,590, filed on Sep. 26, 2016.

(51) Int. Cl.
*B65D 71/50* (2006.01)

(52) U.S. Cl.
CPC ..... *B65D 71/50* (2013.01)

(58) Field of Classification Search
CPC . B65D 71/50; B65D 21/0224; B65D 21/0201
USPC ..... 206/512, 139–203
See application file for complete search history.

(56) References Cited

U.S. PATENT DOCUMENTS 2,349,531 A * 5/1944 Weir ..... B65G 7/12 294/164
2,957,601 A * 10/1960 Novick ..... B65D 21/0224 206/503
3,199,908 A * 8/1965 Poupitch ..... B65D 71/50 206/151
3,250,564 A * 5/1966 Stern ..... B65D 71/50 206/151
3,258,288 A * 6/1966 Courter ..... B65D 71/50 206/151
3,317,087 A * 5/1967 Landis ..... B65D 47/265 206/427
3,688,899 A * 9/1972 Walter ..... B65D 71/50 206/145
3,885,672 A * 5/1975 Westenrieder ..... B65D 71/502 206/503
4,120,396 A * 10/1978 Mascia ..... B65D 71/50 206/151
5,105,964 A * 4/1992 Heath ..... B65D 43/0212 220/212
5,156,273 A * 10/1992 Mortensen ..... B29C 65/08 156/321
5,735,562 A 4/1998 Borg
D405,687 S 2/1999 Borg
6,129,397 A 10/2000 Borg
6,394,517 B1 5/2002 Borg
6,715,810 B2 4/2004 Borg
(Continued)

*Primary Examiner* — Chun Hoi Cheung
(74) *Attorney, Agent, or Firm* — Thompson Hine L.L.P.

(57) ABSTRACT

A carrier for attachment to a can top includes at least one ring member with an inner portion and a plurality of tab members extending downward from an outer side of the inner portion. Each of the tab members includes an upper leg and a lower curved segment, where the lower curved segment includes opposed free ends that have can engaging lips.

21 Claims, 21 Drawing Sheets

(56) References Cited

U.S. PATENT DOCUMENTS

| | | | | |
|---|---|---|---|---|
| 6,789,828 | B1 | 9/2004 | Borg | |
| 6,808,070 | B2 | 10/2004 | Borg | |
| 7,108,128 | B2 | 9/2006 | Borg | |
| 7,147,100 | B1 | 12/2006 | Borg | |
| 7,377,382 | B2 | 5/2008 | Borg | |
| 7,387,200 | B2 | 6/2008 | Borg | |
| 7,404,486 | B2 * | 7/2008 | Smithers | B65D 71/70 206/139 |
| 7,448,493 | B2 * | 11/2008 | Wong | B65D 71/50 206/151 |
| 7,588,275 | B2 * | 9/2009 | Borg | B65D 21/0224 206/151 |
| 7,614,495 | B1 * | 11/2009 | Smithers | B65D 81/361 206/150 |
| 7,823,943 | B2 | 11/2010 | Borg | |
| 7,861,853 | B2 * | 1/2011 | Borg | B65D 71/50 206/151 |
| 7,958,997 | B2 * | 6/2011 | Smithers | B65D 71/50 206/145 |
| D700,526 | S | 3/2014 | Borg | |
| D704,571 | S | 5/2014 | Borg | |
| D704,572 | S | 5/2014 | Borg | |
| D705,082 | S | 5/2014 | Borg | |
| D705,666 | S | 5/2014 | Borg | |
| D721,598 | S | 1/2015 | Borg | |
| D722,891 | S | 2/2015 | Borg | |
| 9,517,859 | B2 * | 12/2016 | Borg | A47F 7/0071 |
| 2012/0073997 | A1 | 3/2012 | Borg | |
| 2015/0210428 | A1 * | 7/2015 | Borg | A47F 7/0071 24/288 |

* cited by examiner

CAN CARRIER

CROSS-REFERENCES

This application claims the benefit of U.S. Application Ser. No. 62/399,590, filed Sep. 26, 2016, which is incorporated herein by reference.

TECHNICAL FIELD

This application relates generally to carriers used for cans and, more specifically, to a can carrier that engages the tops of cans and that facilitates stacking.

BACKGROUND

A variety of can carrier configurations are known. Where a can carrier is molded of plastic material, the can carrier is commonly utilized to carry in a multi-pack arrangement to carry a plurality of cans simultaneously (e.g., a 4 pack of cans or a 6 pack of cans).

It would be desirable to provide a carrier that provides desirable gripping of the tops of cans while enabling user removal of the cans and/or a carrier that engages the tops of cans and facilitates stacking of can packs.

SUMMARY

In one aspect, a can carrier includes one or more ring members having downwardly extending can gripping tab members with inverted T-shapes. The ring members may also include one or more upwardly and outwardly extending stacking tongues.

In another aspect, a can carrier includes at least one ring member with an inner portion and a plurality of tab members extending downward from an outer side of the inner portion. Each of the tab members includes an upper leg and a lower curved segment, where the lower curved segment includes opposed free ends that have can engaging lips.

In a further aspect, a can carrier includes at least one ring member including an inner portion and a plurality of tab members extending downward from an outer side of the inner portion. Each of the tab members including an upper leg and a lower arcuate segment.

In yet another aspect, a can carrier includes at least one ring member including an inner portion, a first tab member and a second tab member, each tab member extending downward from an outer side of the inner portion. Each of the first and second tab members includes an upper leg and a lower curved segment, wherein each leg connects to the outer side by a radial extent and extends downward from the radial extent to connect to a central portion of the curved segment. Each curved segment includes first and second opposed distal arm portions extending in opposite directions from the central portion. Each distal arm portion has an inner end connected to the central portion and the distal arm portion forms a free end that is not connected to the ring member other than via the leg.

In still another aspect, a can carrier includes at least one ring member including an inner ring portion, a first tab member extending downward from an outer side of the inner ring portion, and a second tab member extending downward from the outer side of the inner ring portion, the second tab member diametrically opposed to the first tab member. Each of the first and second tab members includes a connecting leg and a lower curved segment. Each lower curved segment includes a central portion aligned with the connecting leg and first and second opposed distal arm portions extending in opposite directions from the central portion. Each distal arm portion has a corresponding free end. Each distal arm portion includes an inward facing side with an inwardly extending lip, and each tab member is configured to permit slight flexing during application of the ring member to a can top.

The details of one or more embodiments are set forth in the accompanying drawings and the description below. Other features, objects, and advantages will be apparent from the description and drawings, and from the claims.

DETAILED DESCRIPTION

Figure 1:
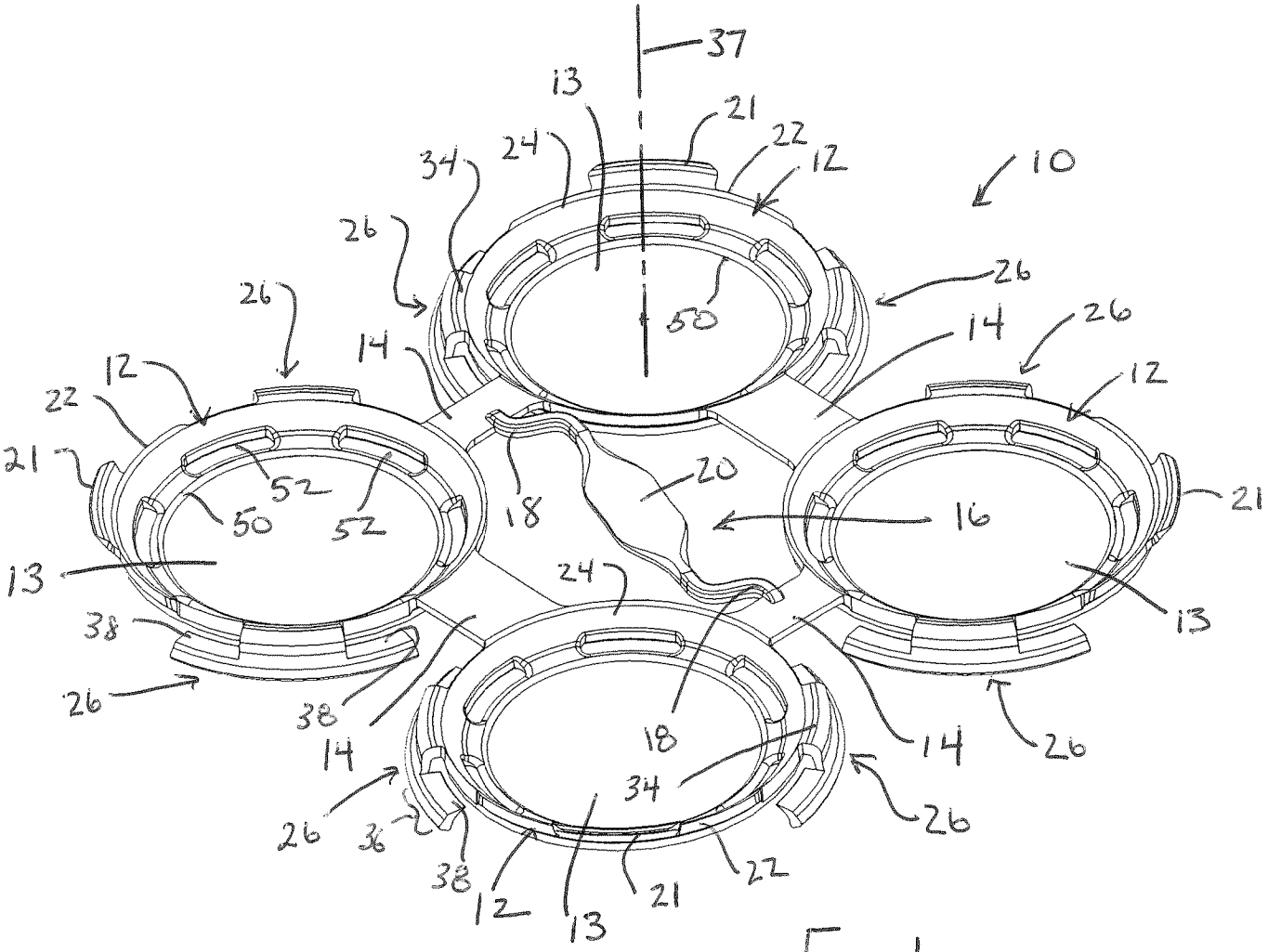
FIG. 1 shows a top perspective of one embodiment of a can carrier.
Figure 2:
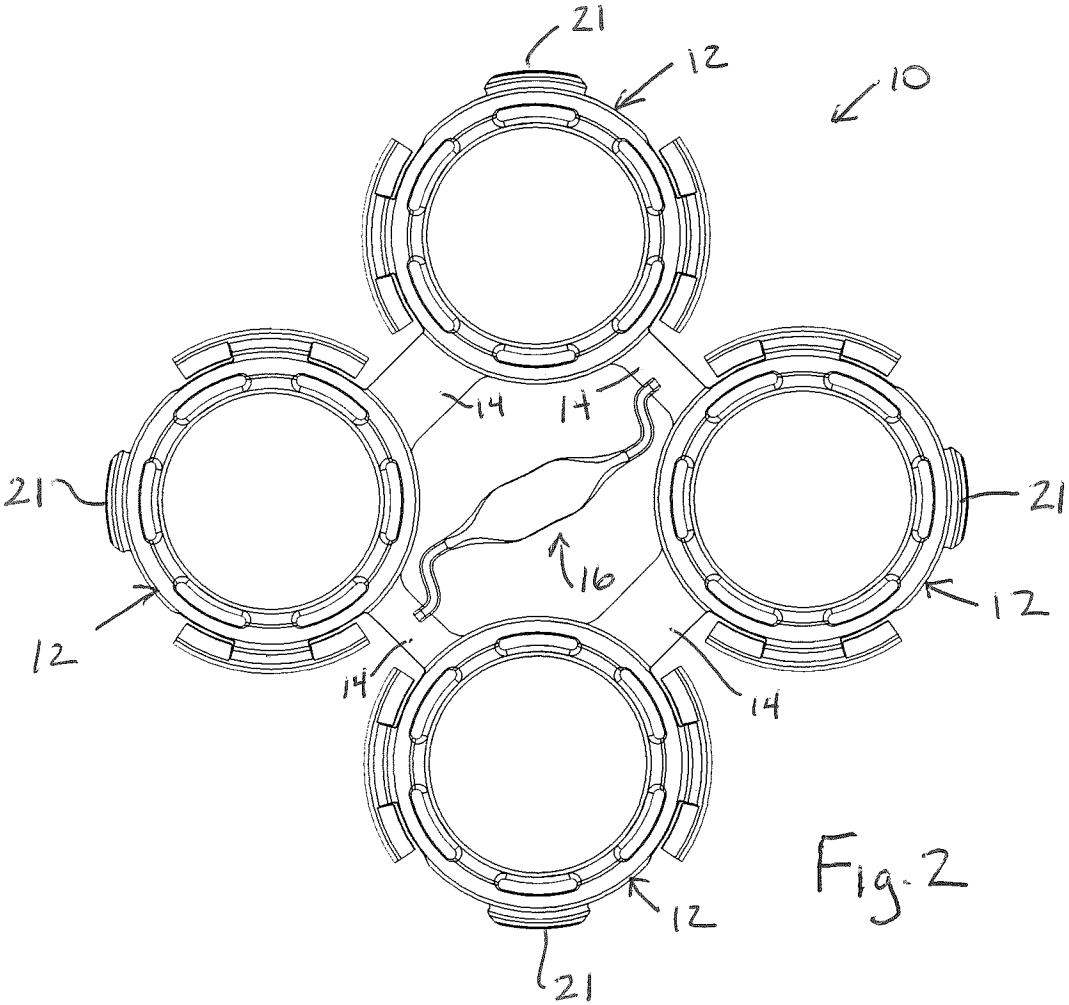
FIG. 2 shows a top plan view of the carrier.
Figure 3:
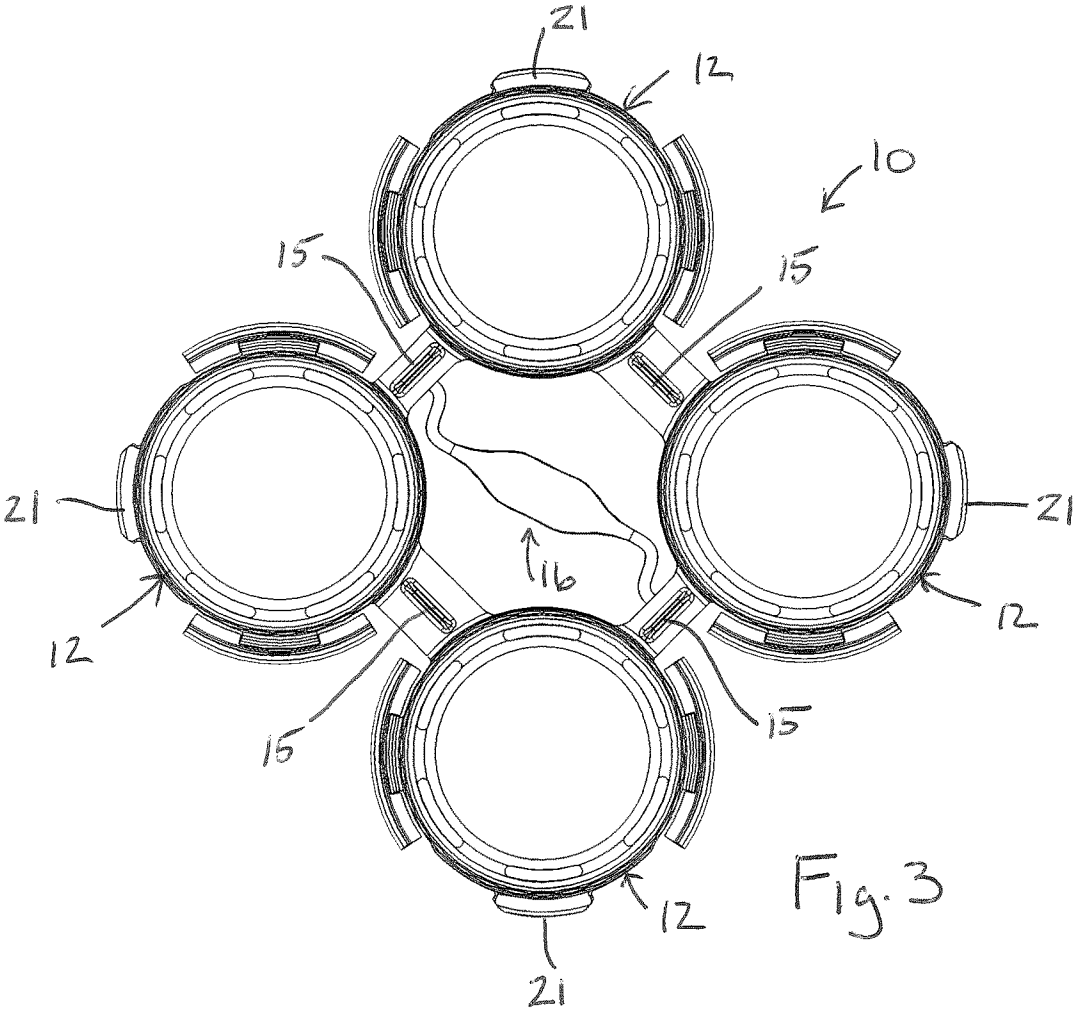
FIG. 3 shows a bottom plan view of the carrier.
Figure 4:
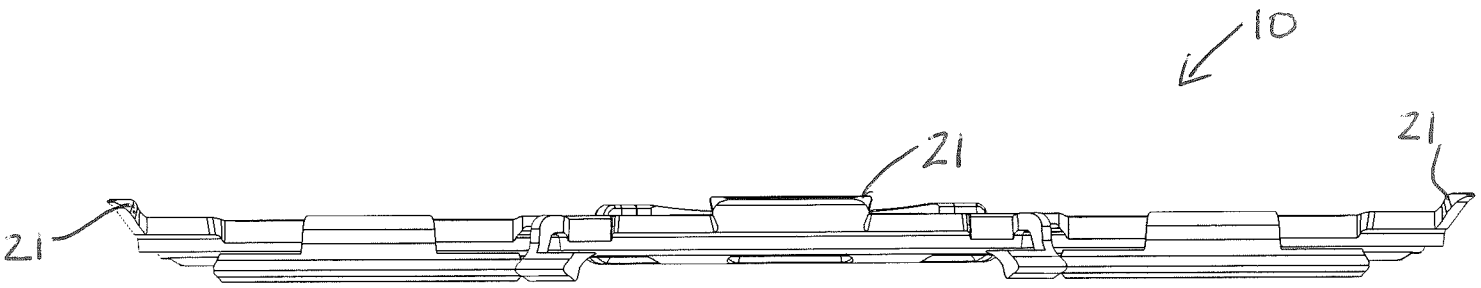
FIG. 4 shows a side elevation view of the carrier.
Figure 5:
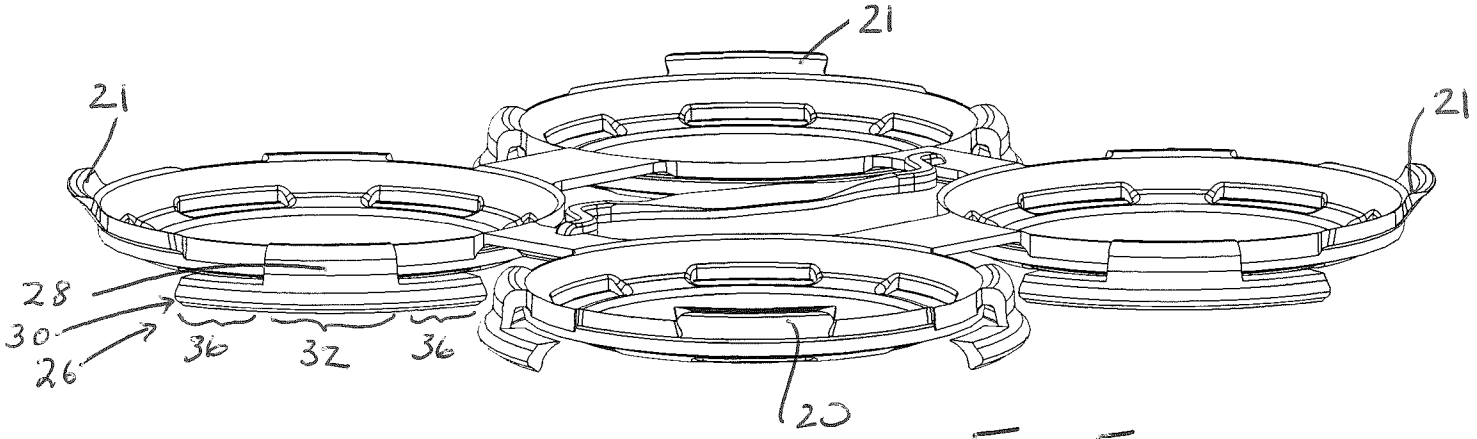
FIG. 5 shows a perspective view of the carrier.
Figure 6:
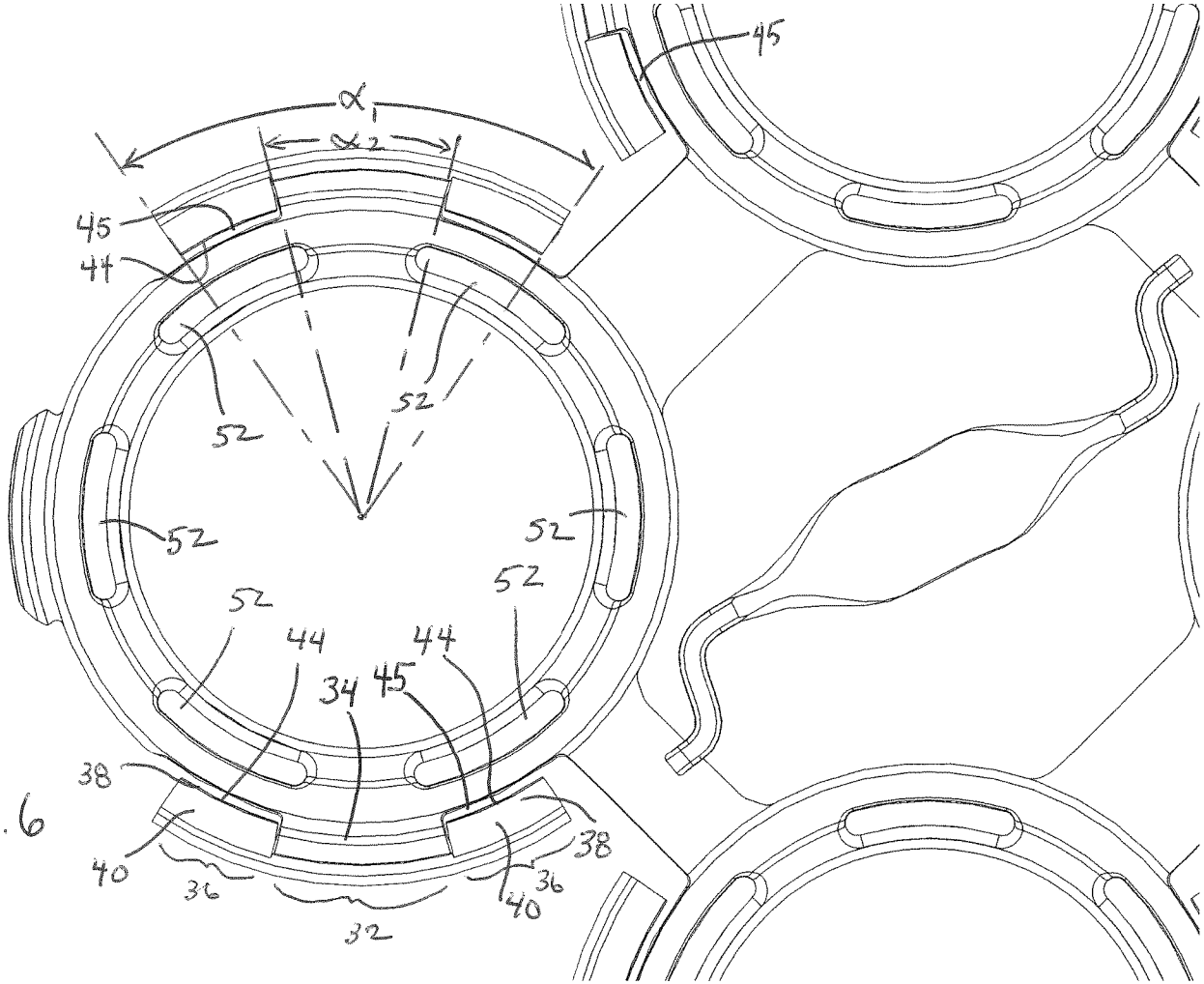
FIG. 6 shows a partial top plan view of the carrier.
Figure 7:
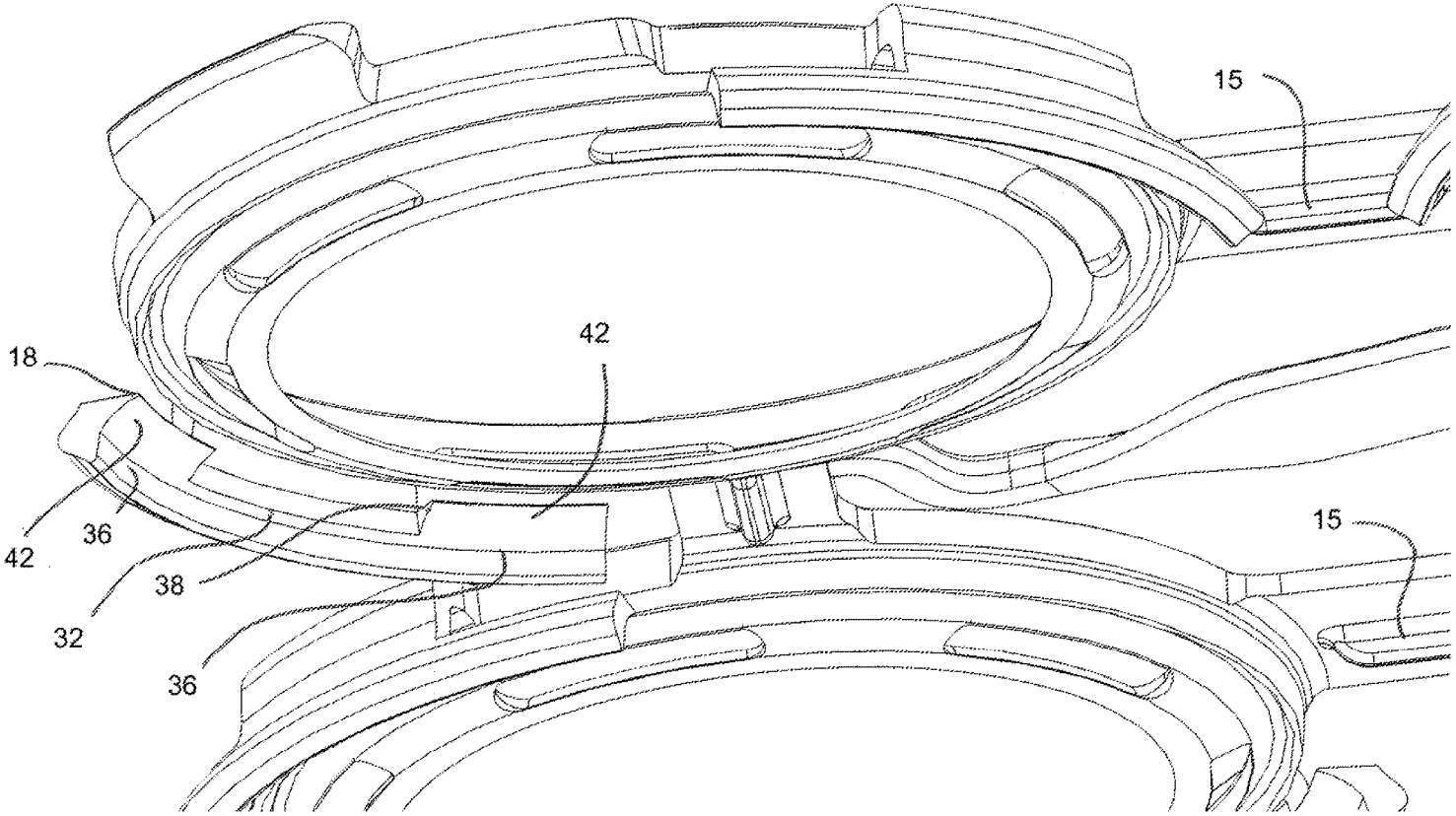
FIG. 7 shows a partial bottom perspective of the carrier.
Figure 8:
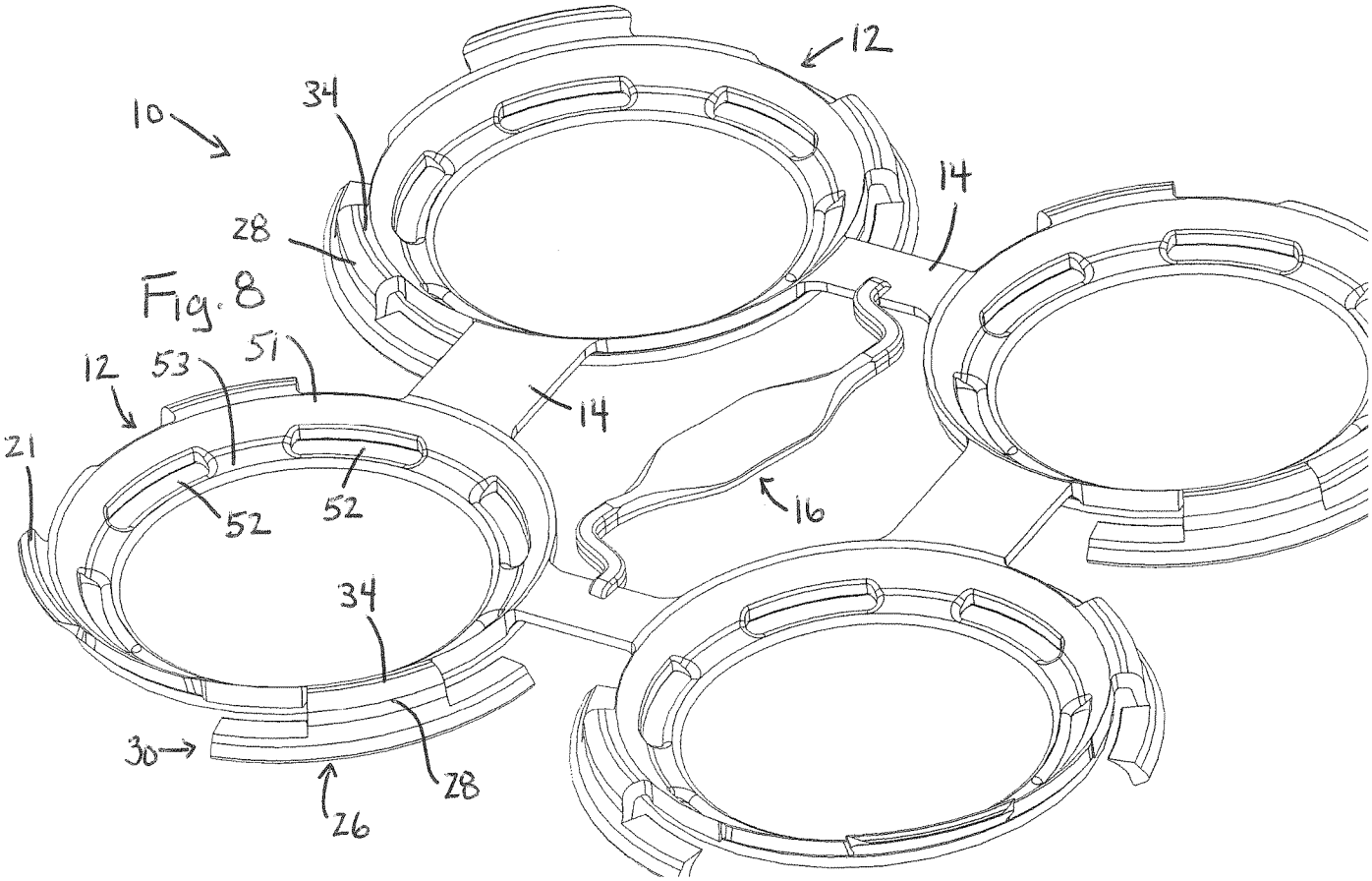
FIG. 8 shows a top perspective view of the carrier.

Referring to FIGS. 1-8, a can carrier 10 or portions thereof are shown in isolation (i.e., not connected to cans). The carrier 10 may, by way of example, be of a molded plastic or other resilient material. The illustrated carrier is configured as a 4-pack carrier and therefore includes a four ring members 12, each of which defines a central ring opening 13 and each of which is configured to be connected a top of a respective can. However, it is recognized that other multi-pack configurations are possible (e.g., a 2-pack carrier with 2 rings, a 3-pack carrier with 3 rings, a 5 pack carrier with 5 rings, a 6-pack carrier with 6 rings and so on), and it is also possible that in certain instances a carrier with just a single ring could be produced.

Where multiple ring members 12 are provided as shown, the ring members 12 are interconnected to each other by connecting straps 14, which, in the illustrated embodiment, are each generally planar on the upper side and run between upper edge portions of the ring members. More specifically, each ring member 12 is connected to two other ring members 12 by two respective connecting straps 14 (one connecting strap 14 per ring-to-ring connection). The underside of each connecting strap 14 may include a stiffening rib 15. A handle member 16 includes strap ends 18, each connected to a respective connecting strap 14, and a central grip portion 20 that runs between the strap ends. The strap ends 18 include a degree of lateral undulation that will enable the handle 16 to move upward when the carrier 10 is connected to cans and is being carried under the load of the cans.

In the case of can carrier 10, each ring member 12 also includes an outer projection in the form of a stacking tongue 21 that extends upwardly and outwardly from an outer side 22 of an inner portion 24 of the ring member. Collectively, the stacking tongues 21 help to properly align can bottoms into position when one multi-pack package assembly (with carrier and cans) is being placed down atop another multi-pack package assembly (e.g., for the purpose of shipment or display). In the illustrated embodiment, each stacking tongue 21 is circumferentially offset from all can gripping tab members 26 of the ring member 12 to which it is connected. The stacking tongues can also be used as a grip to facilitate the can removal process. Of course, embodiments without stacking tongues are also contemplated.

Each ring member 12 includes a pair of can gripping tab members 26 disposed diametrically opposite each other on the ring member 12. The tab members 12 extend outward and downward from the outer side 22 of the inner portion 24 of the ring member 12. Thus, the inner portion 24 of each ring member is generally ring-shaped and forms the major portion or body of each ring member, and the outer tab members 26 are generally smaller and form the minor portion of each ring member that provides the can supporting/gripping function. Each tab member 12 includes an upper leg 28 and a lower arcuate segment 30, wherein the leg 28 connects to the outer side 22 of the inner portion via a radial extent 34 and extends downward and connects to a central portion 32 of the arcuate segment 30. Each arcuate segment 30 includes opposed arcuate arm portions 36 extending in opposite directions from the central portion 32, where each arm portion 36 has an inner end connected to the central portion 32 and a free end that is not connected to the ring member other than via the inner end, central portion 32, leg 28 and radial extent 34.

Each arcuate arm portion 36 includes a radially inwardly extending arcuate lip 38, which extends toward a central axis 37 that passed upward through the center of the ring member opening 13. On the other hand, the central portion 32 lacks a radially inwardly extending lip. Each radially inwardly extending lip 38 has a substantially planar upper surface 40 and a ramped lower surface 42 that extends downwardly and outwardly from an inner edge 44 of the lip. In top plan view the inner edge 44 of each lip is spaced from the outer edge of the outer side 22 producing an arcuate gap 45.

The arcuate segment 30 extends through an angle $\alpha 1$ that may, by way example, be at least 50 degrees in order to provide good can retention when engaged with the top of can (e.g., angle $\alpha 1$ may be between 50 degrees and 80 degrees, such as between 65 degrees and 70 degrees). However, other variations are possible. The central portion 32 of the arcuate segment extends through an angle $\alpha 2$ that may, by way of example, be at least 25 degrees to provide high rigidity in the tab member (e.g., angle $\alpha 2$ may be between 25 degrees and 35 degrees). However, other variations are possible.

An inner side 50 of the inner ring portion is disposed lower than the outer side. The space between outer side 22 and inner side 50 is traversed by a downwardly angled ring part 51 that joins with a substantially planar ring part 53. A plurality of circumferentially spaced apart through slots 52 are located on each ring member 12, with the outer side of each slot extending into ring part 51 and the inner side of each slot extending into ring part 53. The slots 52 reduce material and also aid in cleaning of the can top (e.g., as by rinsing with water or other solution). In the illustrated embodiment, all through slots 52 are circumferentially offset from a center of each leg 28, providing high ring rigidity at the location of the connection of the leg 28. In addition, each arm portion 36 at least partially overlaps circumferentially with a respective through slot 52.

Figure 9:
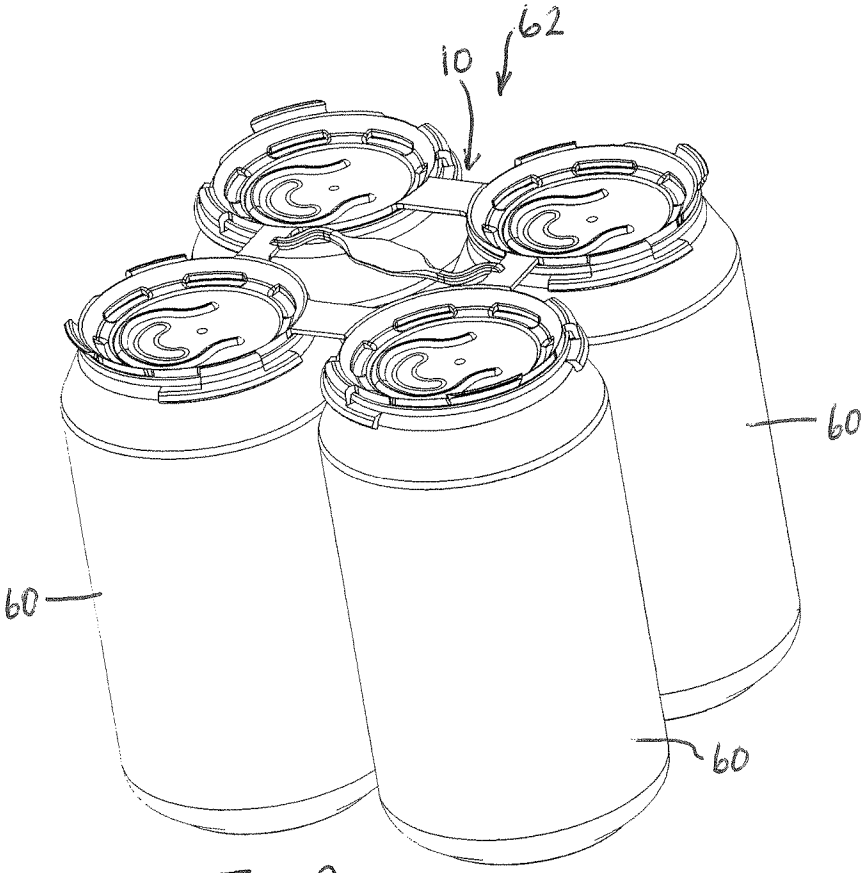
FIG. 9 shows the carrier attached to a set of cans.
Figure 10:
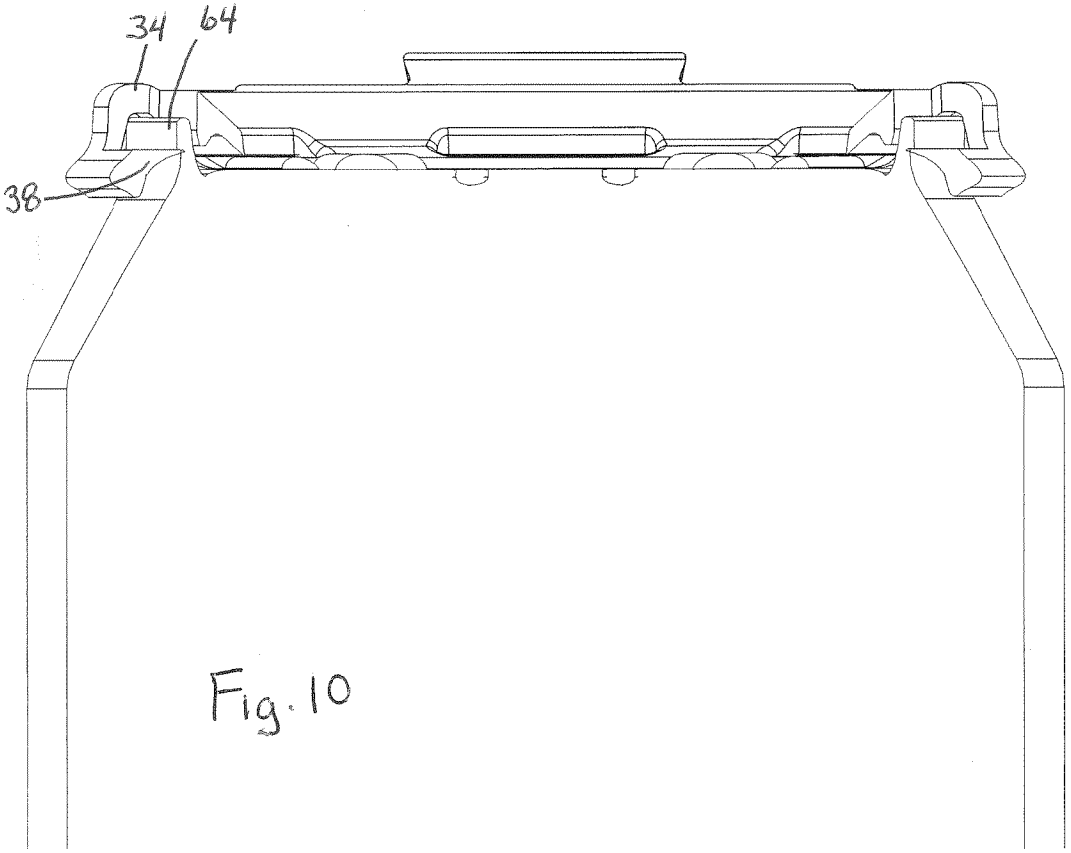
FIGS. 10-15 show partial cross-sections depicting engagement of part of the carrier with a can.
Figure 11:
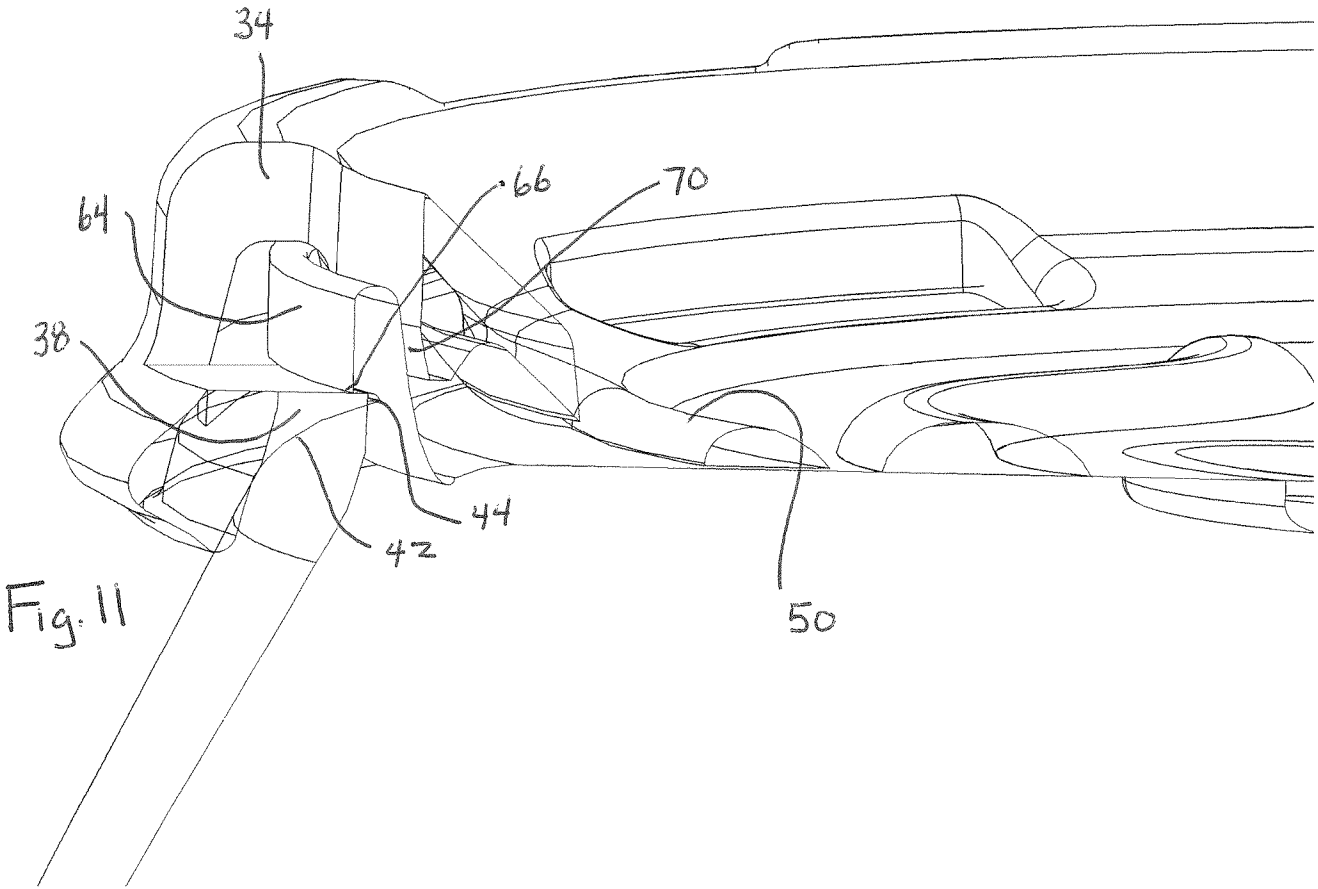
Figure 12:
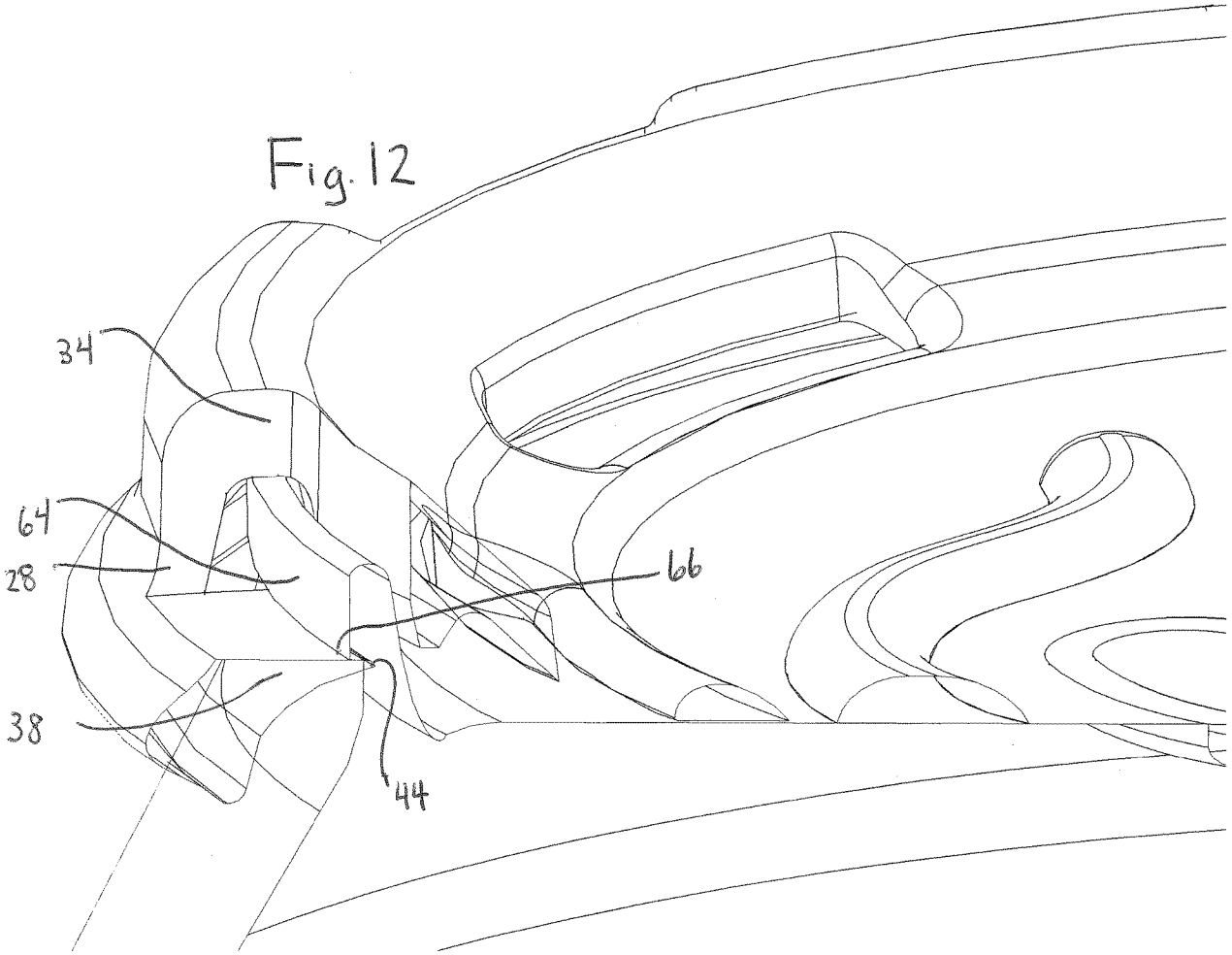
Figure 13:
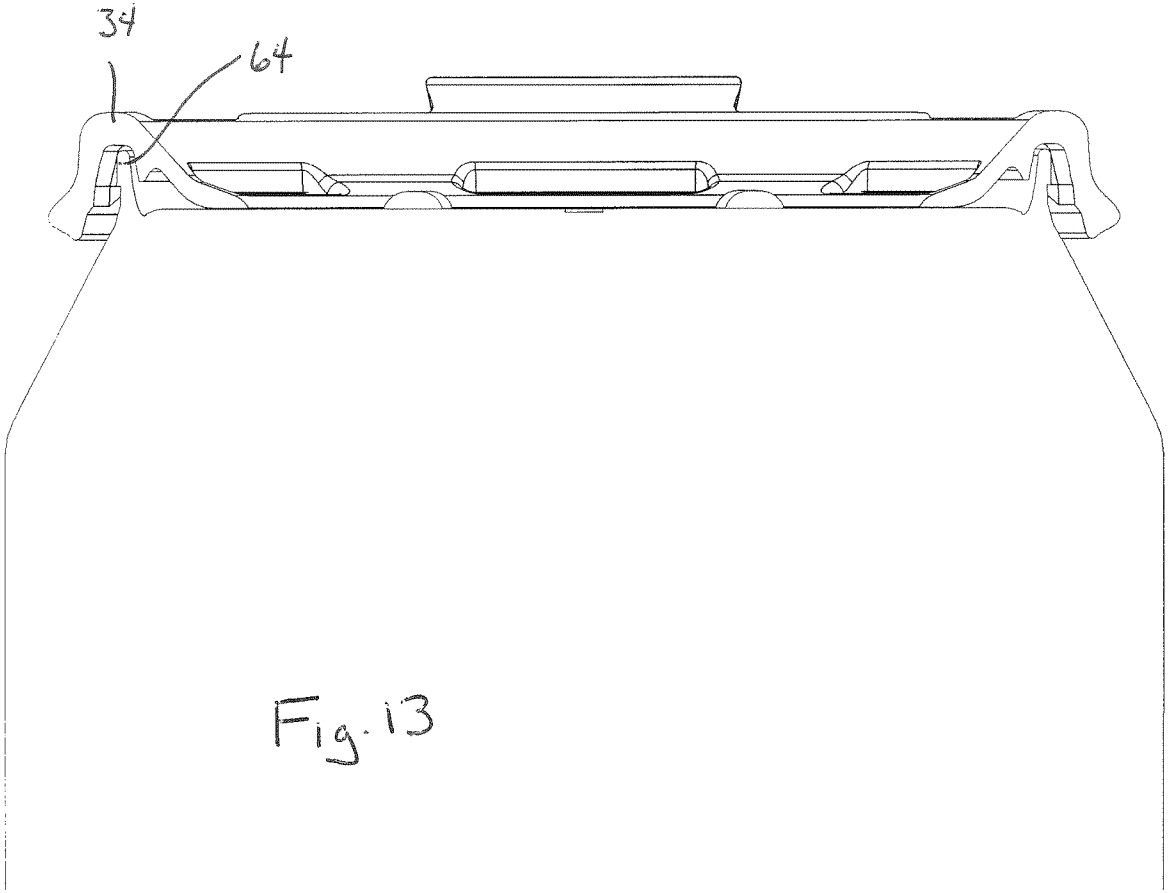
Figure 14:
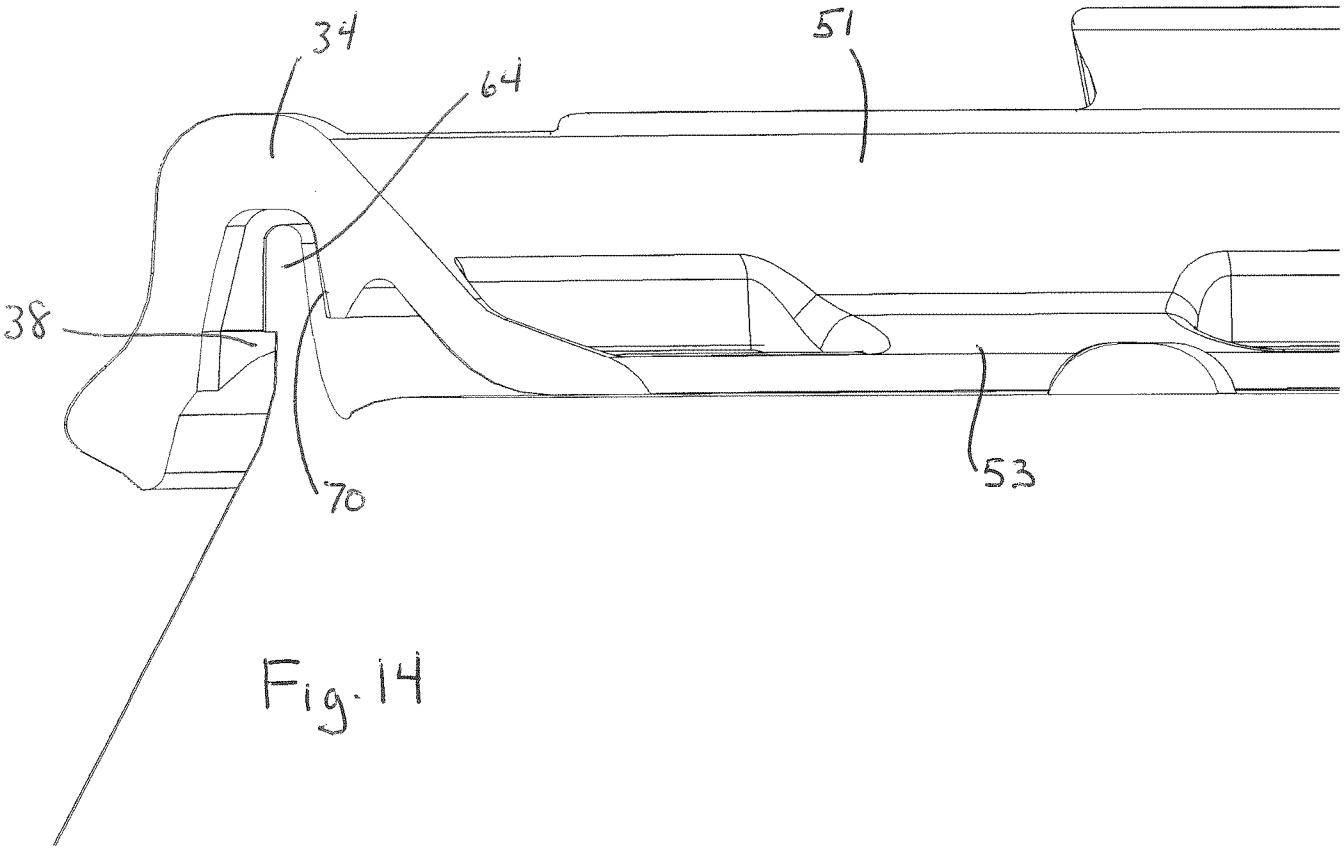
Figure 15:
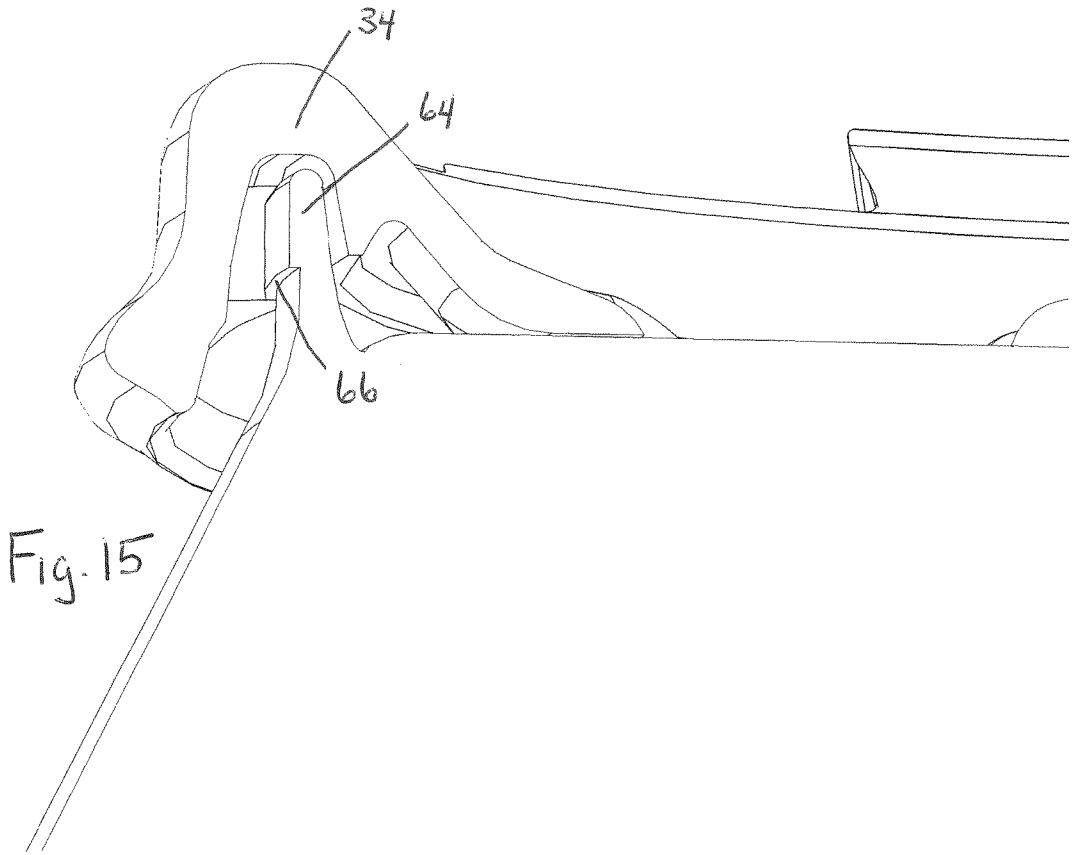
Figure 16:
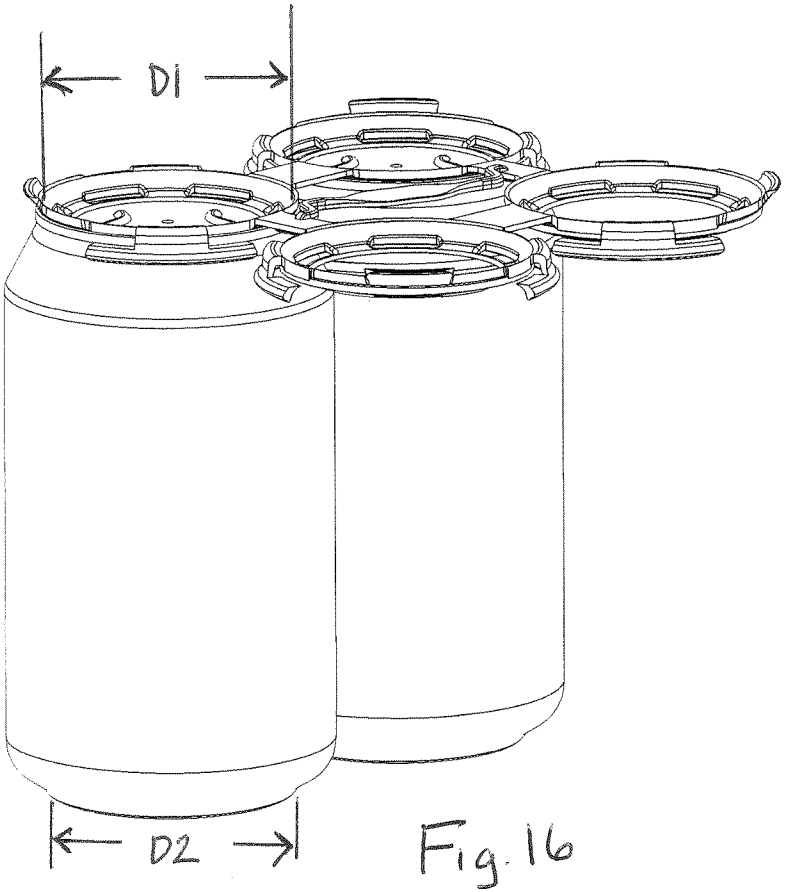
FIG. 16 shows a perspective view of the carrier engaged with two cans.
Figure 17:
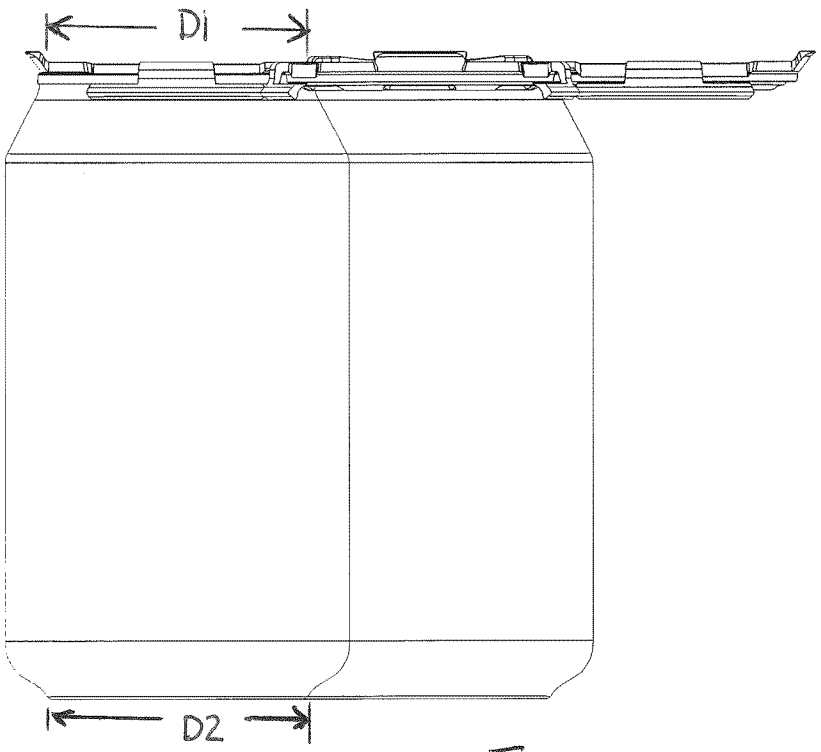
FIG. 17 shows a side elevation of FIG. 16.

Referring now to FIGS. 9-17, the can carrier 10 is shown engaged with cans 60 to form a container package assembly 62. Notably, to place the carrier 10 onto the cans the carrier is simply pressed down onto the cans, and the lower ramp portions 42 of the arcuate lips 38 interact with the can rim 64 to cause outward flex in the tab members 26 until the inner edges 44 of the retention lips move below the bottom edge 66 of the can rim 64. The lips 38 therefore engage the can rim bottom edge 66 to retain the cans when carried.

As seen in the partial cross-sections of FIGS. 10-15, the radial extents 34 extend over a top of the beaded rim 64 of the cans, but the undersides of the radial extents 34 are vertically spaced from the tops of the beaded rims 64. The inner side 50 of the inner portion of the ring member sits atop the upper surface of the can and a radially outer wall 70 of the outer side of the inner portion of the ring member may be configured to engage with the inner side of the rim 64 to limit the downward movement of the ring member onto the can. The bottom of the ring part 53 may also engage the top surface of the can as shown. In the illustrated embodiment, the central ring opening 13 has a cross-sectional area in top plan view that encompasses at least fifty percent (e.g., at least sixty percent) of a cross-sectional area defined by the beaded rim 64 in top plan view.

For the purpose of facilitating stacking of container package assemblies, the inside diameter D1 (FIGS. 16 and 17) of the inwardly tapering part of the inner portion of each ring member 12 may be closely matched to the outside diameter D2 of the tapered bottom of the can. Thus, in a stacked arrangement the bottoms of cans are supported by the inwardly facing surfaces of the ring members 12 and do not make contact with the rims of the lower cans or the upper surface of the lower cans. However, other configurations are possible.

Figure 18:
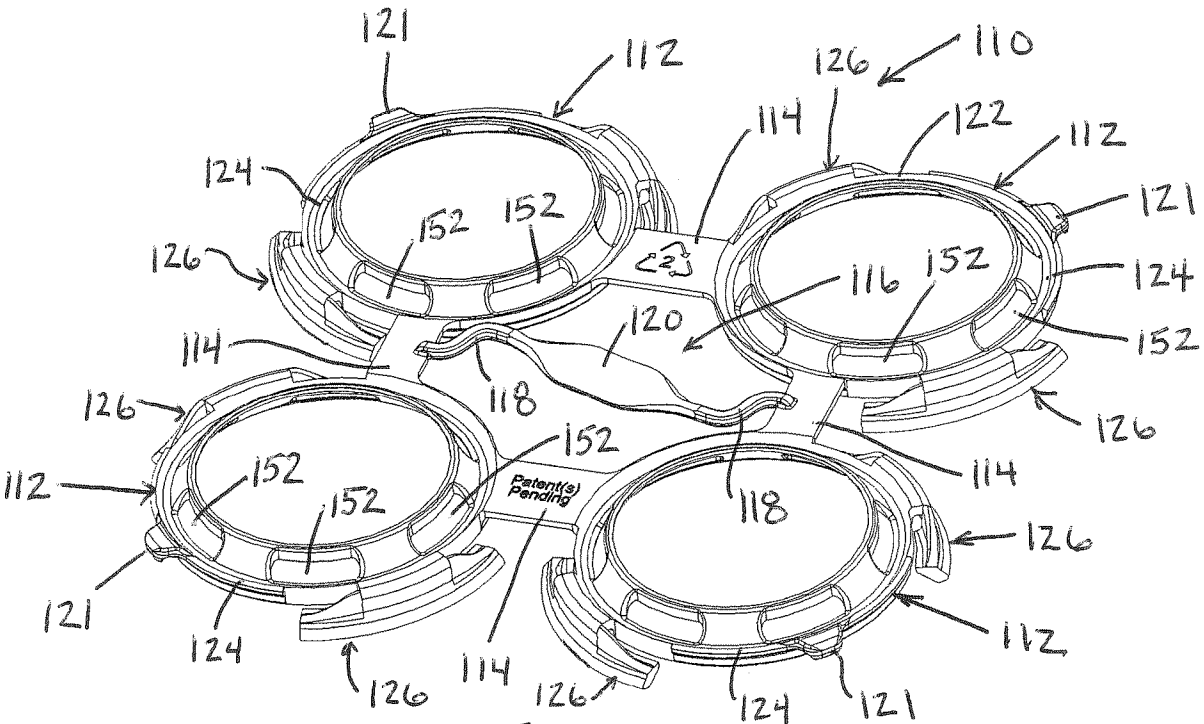
FIG. 18 shows a top perspective of another embodiment of a can carrier.
Figure 19:
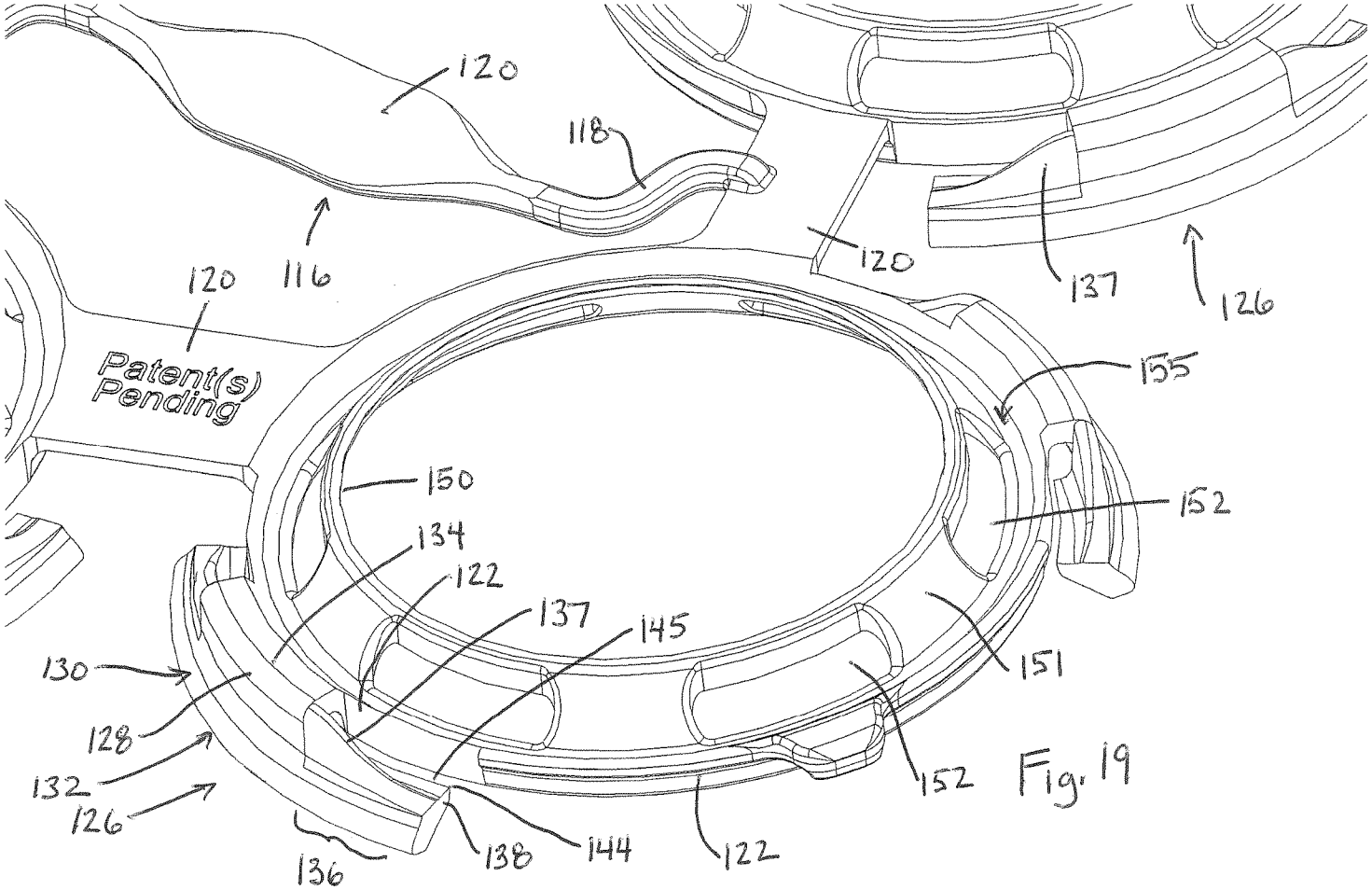
FIG. 19 shows a partial perspective of the can carrier of FIG. 18.
Figure 20:
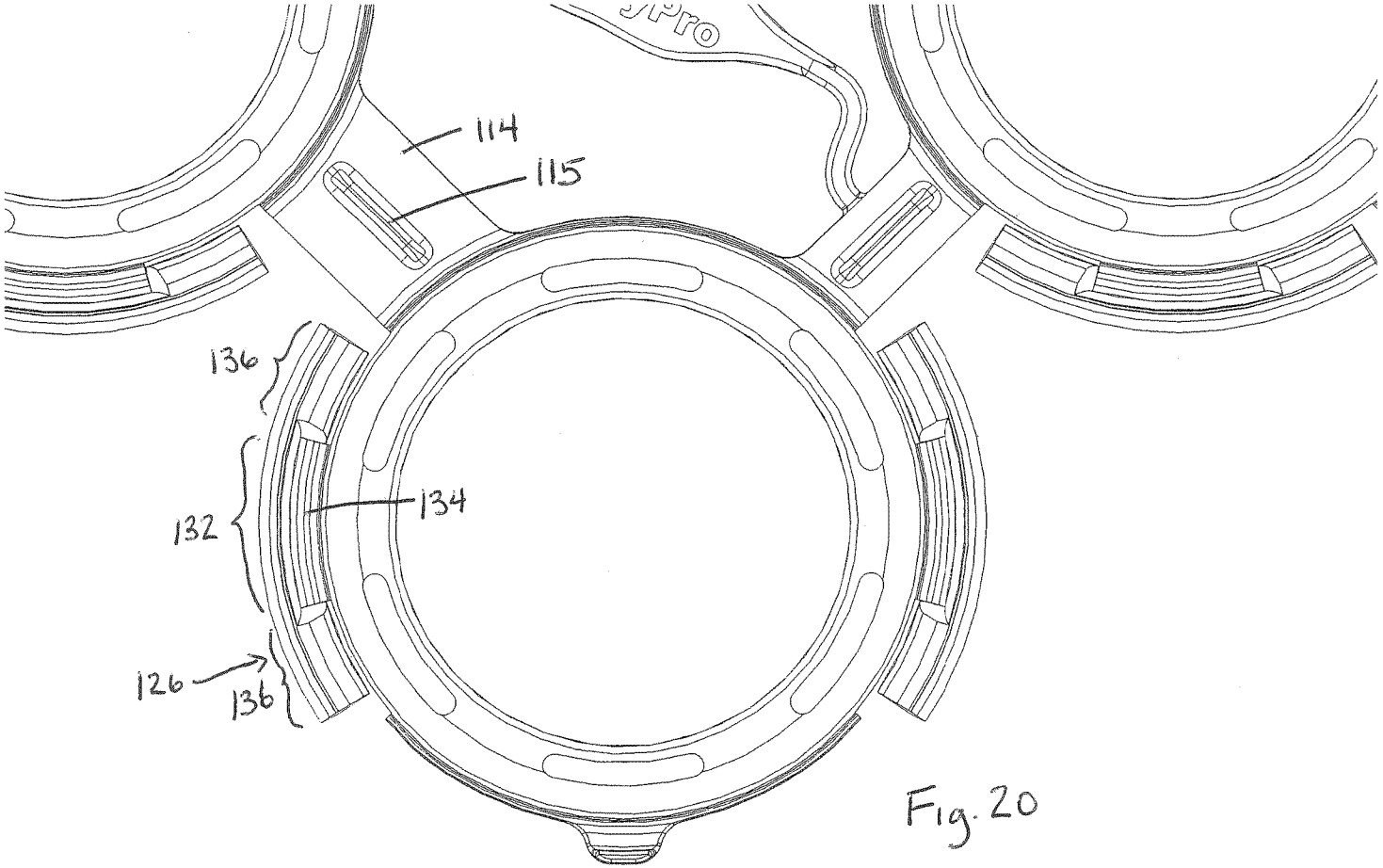
FIG. 20 shows a partial bottom plan view of the carrier of FIG. 18.
Figure 21:
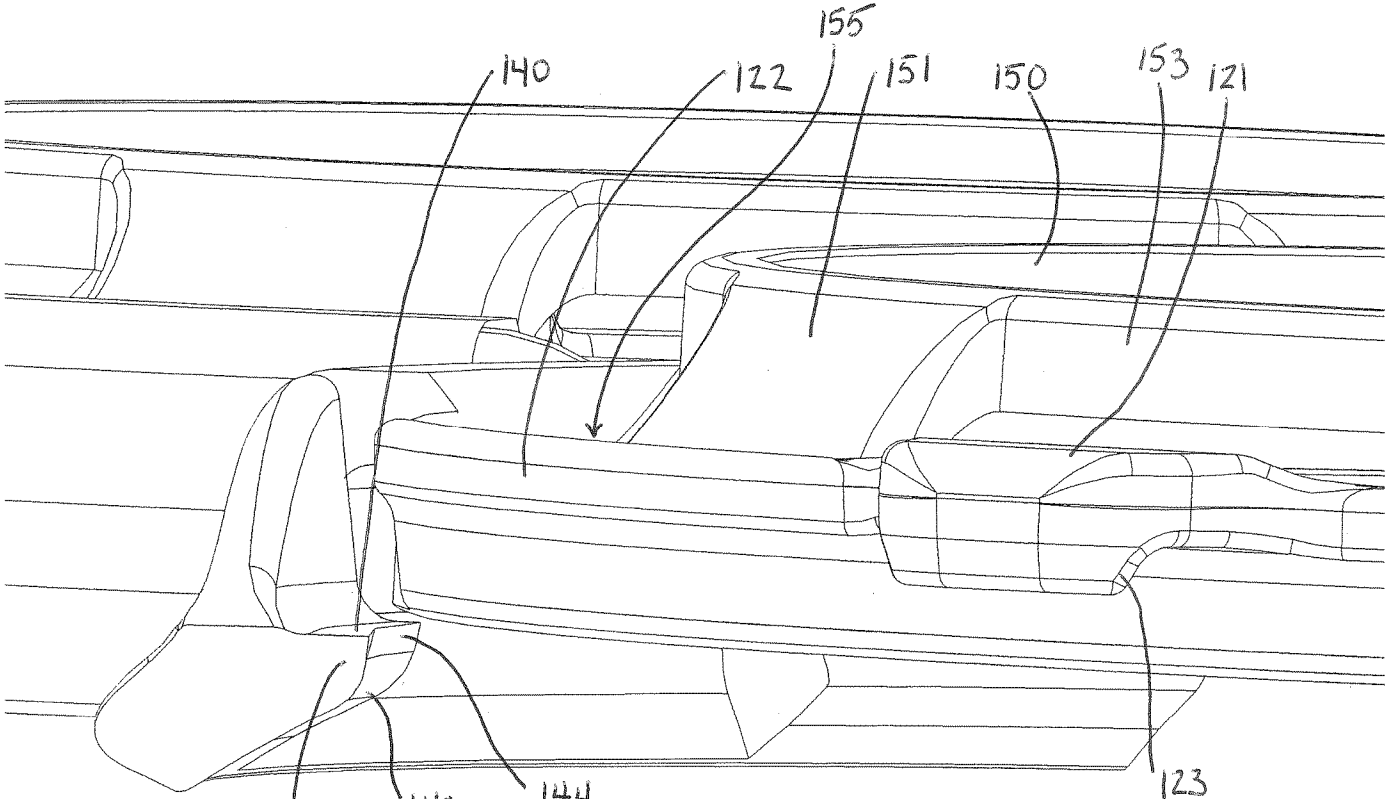
FIG. 21 shows a partial side perspective of the can carrier of FIG. 18.

In this regard, reference is made to FIGS. 18-22 showing another embodiment of a can carrier 110, also in the form of a 4-pack carrier that includes a four ring members 112, each of which is configured to be connected to the top of a respective can. The ring members 12 are interconnected to each other by connecting straps 114, which may be generally planar on the upper side and include a stiffening rib 115 at the underside. A handle member 116 includes strap ends 118, each connected to a respective connecting strap 114, and a central grip portion 120.

In the case of can carrier 110, each ring member 112 also includes an outer projection in the form of an outer non-gripping tab 121 that extends outwardly from an outer side 122 of an inner portion 124 of the ring member and that has a short downward extent 123 at the outer distal end. The tabs 121 will extend of can rims when the carrier is installed, providing some degree of can rim protection. The tabs 121 can also be used as grips to facilitate the can removal process.

Each ring member 112 includes a pair of can gripping outer tab members 126 disposed diametrically opposite each other on the ring member 112. The tab members 112 extend outward and downward from the outer side 122 of the inner portion 124 of the ring member 112. Thus, the inner portion 124 of each ring member is generally ring-shaped and forms the major portion or body of each ring member, and the outer tab members 126 are generally smaller and form the minor portion of each ring member that provides the can supporting/gripping function. Each tab member 112 includes an upper leg 128 and a lower arcuate segment 130, wherein the leg 128 connects to the outer side 122 of the inner portion via a radial extent 134 and extends downward and connects to a central portion 132 of the arcuate segment 130. Each arcuate segment 130 includes opposed arcuate arm portions 136 extending in opposite directions from the central portion 132, where each arm portion 136 has an inner end connected to the central portion 132 and a free end that is not connected to the ring member other than via the leg 128 and its radial extent 134. Here, an angled shoulder 137 also extends between the leg 128 and each arcuate arm portion 136 to provide increased rigidity against excessive flexing of portions 136 relative to the leg 128.

Each arcuate arm portion 136 includes a radially inwardly extending arcuate lip 138. On the other hand, the central portion 132 lacks a radially inwardly extending lip. Each radially inwardly extending lip 138 has a substantially planar upper surface 140 and a ramped lower surface 142 that extends downwardly and outwardly from an inner edge 144 of the lip. In top plan view the inner edge 144 of each lip is spaced from the outer edge of the outer side 122 producing an arcuate gap 145.

The arcuate segment 130 extends through an angle (not labeled) similar to angle $\alpha 1$ noted above for segment 30, and the central portion 132 of the arcuate segment 130 may extend through an angle (not labeled) similar to angle $\alpha 2$ of central portion 32 noted above.

Here, an inner side 150 of the inner ring portion is disposed higher than the outer side 122. The space between outer side 122 and inner side 150 is traversed by a upwardly angled ring part 151 that joins with a substantially planar ring part 153.

A plurality of circumferentially spaced apart through slots 152 are located on each ring member 112, with the outer side of each slot extending into and along a majority of the ring part 151 and the inner side of each slot extending to the outer edge of ring part 153. All through slots 152 may be circumferentially offset from a center of each leg 128, and each arm portion 136 may at least partially overlap circumferentially with a respective through slot 152.

The carrier 110 connects with top of a can in a similar manner as carrier 10, with the lips 138 engaging the can rim edges. However, in a system of stacked package assemblies formed by carriers 110 engaged with cans, the ring part 153 and a majority of ring part 151 may extend up into a the upward recess at the bottom of an overlying can. Thus, an annular recess 155 may be formed between each ring part 153 and outer side 122 to provide a seating area for the bottommost periphery of the overlying can.

It is to be clearly understood that the above description is intended by way of illustration and example only, is not intended to be taken by way of limitation, and that other changes and modifications are possible.

What is claimed is:

1. A carrier for attachment to a can top, comprising:

at least one ring member with a central through opening, the ring member including:

an inner portion including a substantially planar inner side ring part and an outer side ring part, wherein the inner side ring part is disposed higher than the outer side ring part and a space between the outer side ring part and the inner side ring part is traversed by an upwardly angled ring part having a plurality of circumferentially spaced apart through slots;

a plurality of tab members extending downward from an outer side of the outer side ring part of the inner portion, each of the tab members including an upper leg and a lower arcuate segment.

2. The carrier of claim 1 wherein each leg connects to the outer side ring part and extends downward and connects to a central portion of the arcuate segment.

3. The carrier of claim 2, including a can connected with the ring member, wherein each leg is connected to the outer side ring part via a radial extent that extends over a top of a beaded rim of the can.

4. The carrier of claim 3 wherein an underside of each radial extent is vertically spaced from the top of the beaded rim of the can.

5. The carrier of claim 2 wherein the arcuate segment includes first and second opposed arcuate arm portions extending in opposite directions from the central portion.

6. The carrier of claim 5 wherein each arm portion has an inner end connected to the central portion and a free end that is not connected to the ring member other than via the leg.

7. A carrier for attachment to a can top, comprising:

at least one ring member including:

an inner portion;

a plurality of tab members extending downward from an outer side of the inner portion, each of the tab members including:

an upper leg and a lower arcuate segment, wherein the upper leg connects to the outer side and extends downward and connects to a central portion of the arcuate segment, wherein the arcuate segment includes first and second opposed arcuate arm portions extending in opposite directions from the central portion, wherein each arm portion has an inner end connected to the central portion and a free end that is not connected to the ring member other than via the leg, wherein each of the first and second opposed arcuate arm portions includes a respective radially inwardly extending arcuate lip, and wherein the central portion lacks a radially inwardly extending lip.

8. The carrier of claim 7 wherein each of the radially inwardly extending lips has a substantially planar upper surface portion at an inner edge of the lip and a ramped lower surface that extends downwardly and outwardly from the inner edge of the lip.

9. The carrier of claim 6 wherein each arcuate segment extends circumferentially through between 50 degrees and 80 degrees in top plan view.

10. The carrier of claim 6 wherein each arcuate segment extends circumferentially through between 65 degrees and 70 degrees in top plan view.

11. The carrier of claim 9 wherein each central portion extends circumferentially through between 25 degrees and 35 degrees in top plan view.

12. The carrier of claim 9 wherein an annular, upwardly facing recess is formed between the inner side ring part and the outer side ring part for receiving a can bottom of an overlying can in a stacked arrangement.

13. The carrier of claim 1 wherein all through slots are circumferentially offset from a center of each leg member.

14. The carrier of claim 1 wherein the carrier includes multiple ring members, each ring member connected to at least one other ring member by a substantially planar connecting strap.

15. The carrier of claim 14 wherein a handle member includes a first strap end connected to one connecting strap, a second strap end connected to another connecting strap and a central grip portion between the first strap end and the second strap end.

16. A carrier for attachment to a can top, comprising:

at least one ring member including:

an inner portion;

a plurality of tab members extending downward from an outer side of the inner portion, each of the tab members including an upper leg and a lower arcuate segment wherein the carrier includes multiple ring members and each ring member has at least one outer projection in the form of at least one of (i) a stacking tongue extending upwardly and outwardly from the outer side of the inner portion of the ring member or (ii) a non-gripping tab extending outward and radially downward from the outer side of the inner portion of the ring member.

17. The carrier of claim 16 wherein the outer projection of each ring member is circumferentially offset from any tab member of the ring member.

18. A carrier for attachment to a can top, comprising:

at least one ring member including:

an inner portion;

a first tab member and second tab member extending downward from an outer side of the inner portion, each of the first and second tab members including an upper leg and a lower curved segment, wherein each leg connects to the outer side by a radial extent and extends downward from the radial extent to connect to a central portion of the curved segment, wherein each curved segment includes first and second opposed distal arm portions extending in opposite directions from the central portion, wherein each distal arm portion has an inner end connected to the central portion and the distal arm portion forms a free end that is not connected to the ring member other than via the leg, wherein an upper shoulder part interconnects each distal arm portion with its corresponding leg.

19. The carrier of claim 17 wherein each distal arm portion includes a radially inwardly extending lip, wherein each of the radially inwardly extending lips has a substantially planar inner edge and a ramped lower surface that extends downwardly and outwardly from the inner edge.

20. The carrier of claim 19, including a can connected with the ring member, wherein the inner edge of each radially inwardly extending lip is engaged with a bottom edge portion of a beaded rim at a top of the can.

21. A carrier for attachment to a can top, comprising:

at least one ring member including:

an inner ring portion;

a first tab member extending downward from an outer side of the inner ring portion, a second tab member extending downward from the outer side of the inner ring portion, the second tab member diametrically opposed to the first tab member, each of the first and second tab members including a connecting leg and a lower curved segment, wherein each lower curved segment includes a central portion aligned with the connecting leg and first and second opposed distal arm portions extending in opposite directions from the central portion, wherein each distal arm portion has a corresponding free end, wherein each distal arm portion includes an inward facing side with an inwardly extending lip, wherein each tab member is configured to permit slight flexing during application of the ring member to a can top, and wherein the central portion lacks any inwardly extending lip.

* * * * *